US007047926B2

(12) United States Patent
Corduan et al.

(10) Patent No.: US 7,047,926 B2
(45) Date of Patent: May 23, 2006

(54) INTAKE MANIFOLD OR DISTRIBUTOR FOR THE THERMAL ENGINE OF A VEHICLE AND PRODUCTION PROCESS THEREOF

(75) Inventors: Pascal Corduan, Walbach (FR); Denis Dunoyer, Wintzenheim (FR); Philippe Rohmer, Ebersheim (FR)

(73) Assignee: Mark IV Systemes Moteurs, Courbevoie (FR)

( * ) Notice: Subject to any disclaimer, the term of this patent is extended or adjusted under 35 U.S.C. 154(b) by 37 days.

(21) Appl. No.: 10/250,600

(22) PCT Filed: Jan. 16, 2002

(86) PCT No.: PCT/EP02/00401

§ 371 (c)(1),
(2), (4) Date: Jan. 13, 2004

(87) PCT Pub. No.: WO02/057608

PCT Pub. Date: Jul. 25, 2002

(65) Prior Publication Data

US 2004/0112322 A1 Jun. 17, 2004

(30) Foreign Application Priority Data

Jan. 17, 2001 (FR) ..... 01 00604

(51) Int. Cl.
*F02M 35/10* (2006.01)

(52) U.S. Cl. ..... 123/184.24; 123/184.61

(58) Field of Classification Search ..... 123/184.21–184.61
See application file for complete search history.

(56) References Cited

U.S. PATENT DOCUMENTS

| | | | | |
|---|---|---|---|---|
| 5,636,605 | A | 6/1997 | Nomizo et al. | |
| 5,715,782 | A | 2/1998 | Elder | |
| 5,813,380 | A * | 9/1998 | Takahashi et al. | 123/184.55 |
| 5,875,758 | A * | 3/1999 | Fujita | 123/336 |
| 5,947,073 | A | 9/1999 | Chaffin et al. | |
| 6,192,849 | B1 * | 2/2001 | Powell | 123/184.34 |
| 6,267,093 | B1 * | 7/2001 | Lohr | 123/184.61 |
| 6,321,718 | B1 | 11/2001 | Mangold et al. | |
| 6,467,449 | B1 * | 10/2002 | Brassell et al. | 123/184.61 |
| 6,581,561 | B1 * | 6/2003 | Brodesser et al. | 123/184.34 |
| 6,666,182 | B1 * | 12/2003 | Schermuly et al. | 123/184.55 |
| 6,679,215 | B1 * | 1/2004 | Benson et al. | 123/184.34 |
| 6,739,301 | B1 * | 5/2004 | Brassell et al. | 123/184.61 |

* cited by examiner

*Primary Examiner*—Marguerite McMahon
(74) *Attorney, Agent, or Firm*—Chapman and Cutler LLP

(57) ABSTRACT

The present invention relates to an intake manifold or distributor for a thermal engine constituted by at least two parts (1, 1') assembled together, in particular two parts made from thermoplastic material assembled by vibration welding and comprising an intake or plenum chamber connected, for fluidic communication, to intake pipes opening into the chamber. Intake manifold or distributor for a thermal engine characterized in that it comprises an additional attached piece (4) comprised, on the one hand, of a main body forming a support and fitting plate and, on the other hand, of pipe portions (6, 6') produced in one piece with said body (5) and defining at least the inlet orifices (6, 6') of said pipes (3), said attached piece (4) being positioned and, if applicable, fixed, prior to assembly of said at least two parts (1, 1') forming said manifold or distributor on or in one of these parts.

20 Claims, 5 Drawing Sheets

INTAKE MANIFOLD OR DISTRIBUTOR FOR THE THERMAL ENGINE OF A VEHICLE AND PRODUCTION PROCESS THEREOF

TECHNICAL FIELD

The present invention relates to the field of products or articles of complex shape produced by assembling a plurality of basic parts or pieces, and more particularly relates to an intake manifold or distributor for the thermal engine of a vehicle and a production process for a manifold or distributor of this type.

BACKGROUND ART

Intake manifolds or distributors constitute closed or hollow pieces with complex and multi-compartmented shapes, not generally allowing production in one piece.

Generally, articles of this type are obtained by mutual assembly of a plurality of distinct parts produced separately by moulding, while seeking divisions generating a minimum number of, preferably two, basic parts which are easy to assemble and allow good sealing of the whole to be obtained.

Intake pipes generally consist, owing to their tubular, elongated and curved structure, of elements which are difficult to obtain from one piece by moulding and, therefore, the assembly plane of the manifold or distributor often crosses them or even follows their longitudinal axis.

U.S. Pat. No. 5,636,605 discloses a composite intake manifold including two parts made from thermoplastic material and assembled together, and an additional attached piece positioned within one of the parts prior to assembly of the two parts. The attached piece defines a plurality of pipe portions which cooperate with complementary portions formed in the part housing the attached piece so as to define inlet pipes of the manifold. The pipe portions of the attached piece define longitudinal halves of the respective pipes, and therefore are joined to the complementary portions by longitudinal weldings extending along their whole length.

However, providing assembly joint segments for the manifold in the region of the pipes weakens the constitution of the latter by directly subjecting them to tensions which can occur between the constituent parts of the manifold and does not allow precise local and therefore reliably sealed assembly, the very long assembly joint also extending to other parts or locations of the manifold.

Moreover, when assembly is carried out by a process which generates mould seams (vibration moulding for example), projections or which does not ensure physical continuity of the internal wall of the pipes, the result is a disturbance of the gaseous flow traversing them.

DISCLOSURE OF INVENTION

The main object of the present invention is to overcome the above-mentioned drawbacks and limitations.

The object is also to reduce the complexity of shape of the parts to be assembled, in particular the part incorporating said pipes, either totally or partially.

The object is finally to provide a manifold, the seal of which is reinforced between the pipes, in particular on the plenum chamber side and which allows a tight seal of each of the pipes.

For this purpose, the present invention relates to an intake manifold for a thermal engine constituted by at least two parts and assembled together and an additional attached piece made from thermoplastic material said manifold comprising an intake chamber connected, for fluidic communication, to intake pipes opening into the intake chamber, characterised in that it comprises an additional attached piece composed of a main body forming a support and fitting plate and of pipe portions produced in one piece with said main body and comprising sleeves defining at least the inlet orifices of said intake pipes opening onto said intake chamber positioned prior to assembly of said at least two parts forming said manifold on or in one of these parts.

BRIEF DESCRIPTION OF THE DRAWINGS

The invention will be better understood with the aid of the description hereinafter which relates to a preferred embodiment given by way of non limiting example and explained with reference to the accompanying schematic drawings, in which.

BEST MODE FOR CARRYING OUT THE INVENTION

Figure 1:
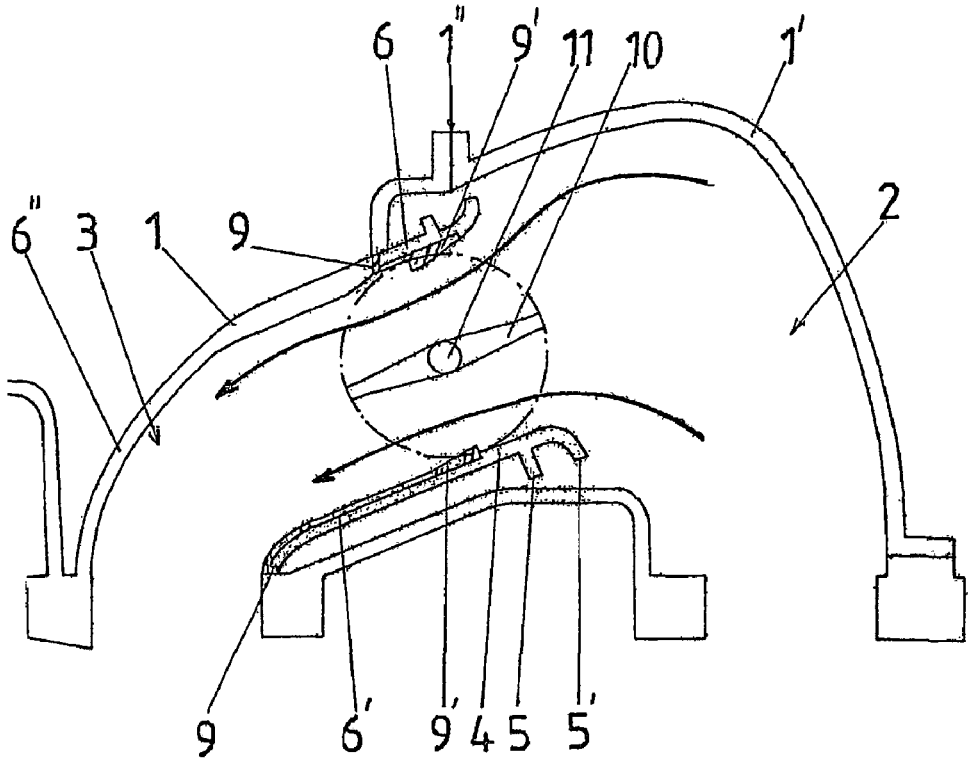
FIG. 1 is a partial sectional view of an intake manifold of the invention according to a plane comprising the longitudinal axis of a pipe of said manifold.

As shown in FIG. 1 the intake manifold or distributor for a thermal engine is constituted by at least two parts 1, 1' assembled together in particular two parts made from thermoplastic material assembled by vibration welding and comprising an intake or plenum chamber connected, for fluidic communication, to intake pipes opening into the chamber.

According to the invention and as shown in FIGS. 2 to 6 in conjunction with FIG. 1, said manifold comprises an additional attached piece 4 composed, on the one hand, of a main body 5 forming a support and fitting plate and, on the other hand, of pipe portions 6, produced in one piece with said body 5 and defining at least the inlet orifices 6, of said pipes 3, said attached piece 4 being positioned and, if applicable, fixed, prior to assembly of said at least two parts 1, 1' forming said manifold or distributor on or in one of these parts.

According to a characteristic of the invention the intake pipe portions 6, 6' comprise, apart from the sleeves 6 forming or extending the inlet orifices of said pipes 3 opening onto the plenum chamber 2, conduit parts or conduit segments 6' extending said inlet orifices 6 and forming portions with a substantially semi-circular section, at least partially constituting said pipes 3.

The conduit segments 6' may extend, for example as shown in FIG. 1 of the accompanying drawings, to the end of the pipes 3, in other words to the fixing flange.

With the attached piece 4 incorporating the pipe portions 3 it is possible to produce the constituent parts 1, 1' of the manifold more easily and, if applicable, to produce intake pipes 3 of complex shape without the necessity for a mould of complicated shape, complex moulding operations and/or a constituent part to be assembled with other additional parts, by appropriately selecting the division of said pipes 3 into portions 6' and 6".

Moreover, the attached piece 4 does not as such form a constituent part of the intake manifold, in particular of the external shell of the latter, but is an insert thereof or a cartridge which is not directly subjected to the load which can be applied between said constituent parts 1, 1'.

Finally, in the case of parts 1, 1" made from thermoplastic material assembled by vibration welding, the use of an attached piece 4 as mentioned above prevents the welding plane passing through the pipes 3 and therefore the formation of welding seams in the region thereof.

This arrangement is of major importance considering the reduction in free space around the engine and the increase in the density of auxiliary devices around the latter (for example injector passage and connection thereof between the pipes on direct injection vehicles).

Moreover, this arrangement avoids the presence of rough areas on the internal walls of the pipes which are likely to disturb good air flow (by burbling) through the latter.

Figure 6:
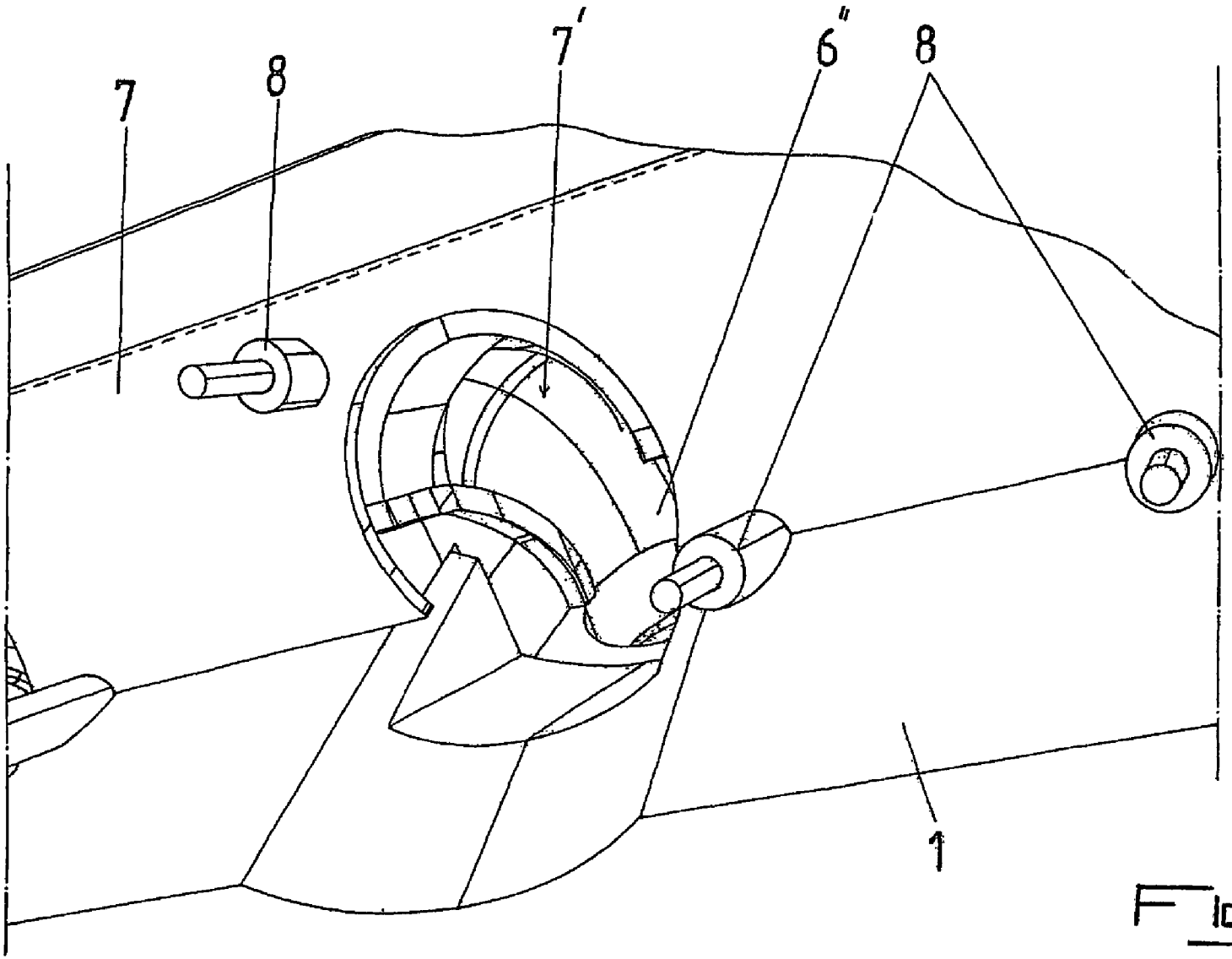
FIG. 6 is a partial perspective view of the part constituting the manifold which receives the attached piece and incorporated the complementary portions of the intake pipes.

According to a preferred embodiment of the invention shown in FIG. 1 and 6 of the accompanying drawings, the constituent part 1 of the manifold comprising the complementary portions 6" of the intake pipes 3 is provided with a wall portion 7 for fitting the main body 5 of the attached piece 5, said wall portion 7 being provided with apertures 7' for the passage of portions of intake pipes 6, 6' of said attached piece 4 for abutting assembly, and cooperating with portions 6" and the adjusted interlocking of at least some of the sleeves 6 forming or extending the inlet orifices of the intake pipe portions 6, 6' of said attached piece 4.

In an advantageous manner said wall portion 7 will have a plane structure, like the main body 5 of the attached piece 4, this latter preferably consisting of two parallel plates 5' 5" connected together by crossmembers consisting of sleeves 6 forming or extending inlet orifices of the pipe portions 6, 6', the intake pipes 3 preferably being aligned with one another in a parallel arrangement (FIGS. 2 to 5).

The attached piece 4 can be locked in position on the constituent part 1 and assembled in a sealed manner with the latter in various ways.

The wall portion 7 is preferably provided with a plurality of positioning and/or fixing sites 8 for the main body 5 of the attached piece 4, for example with pins or lugs which cooperate with complementary sites 8', such as orifices or through passages, for example, produced or formed on the main body 5 of the attached piece 4 and this takes place while fitting the latter on said wall portion 7.

The fitting of the attached piece 4 on the part 1 can be locked and secured by screwing, by clipping, by retention by compression by the other constituent part 1' after assembly thereof with the part 1, by adhesion or otherwise the cooperating sites 8 and 8' possibly present having only a relative positioning and/or temporary holding function.

However, fitting and assembly of said piece 4 on said part 1 can also be carried out simultaneously by mechanical and functional cooperation of said sites 8 and 8', for example by carrying out shaping of the ends of the lugs extending beyond the orifices 8' after assembly of the piece 4 on the part 1.

Figure 2:
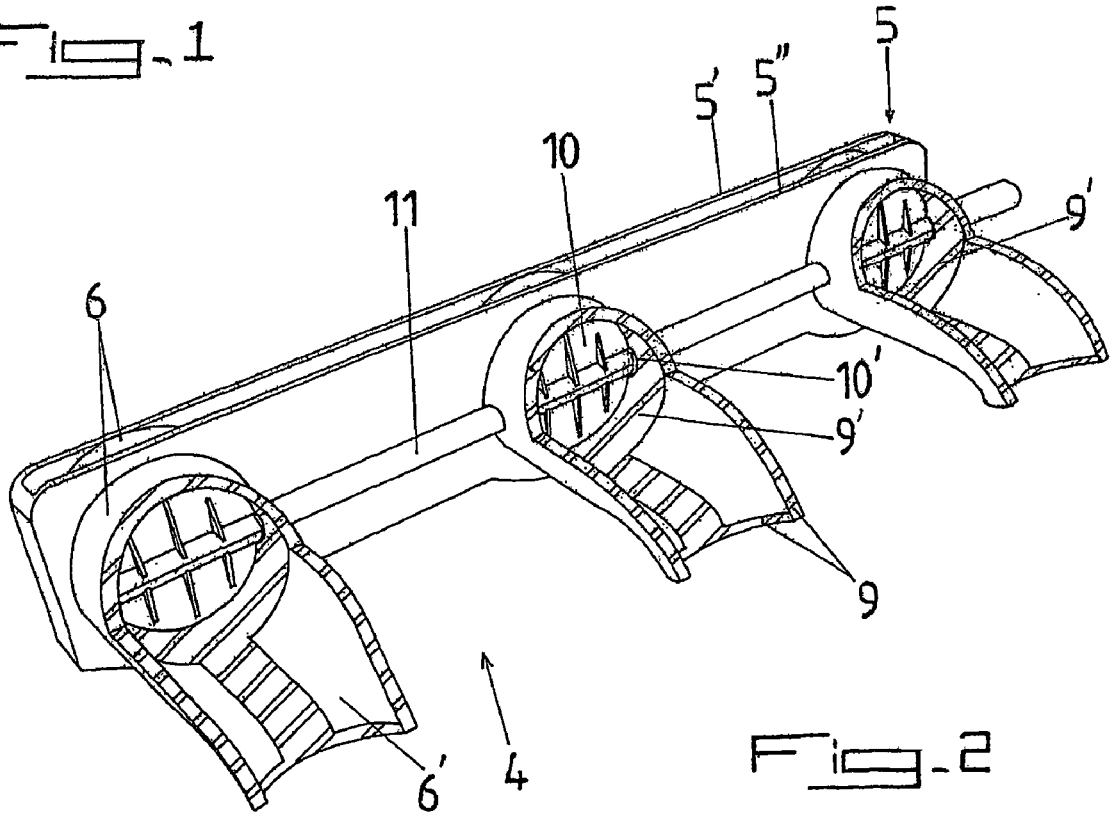
FIG. 2 to 4 are perspective views, according to three different directions, of an attached piece being part of the manifold with three pipes shown in FIG. 1.
Figure 3:
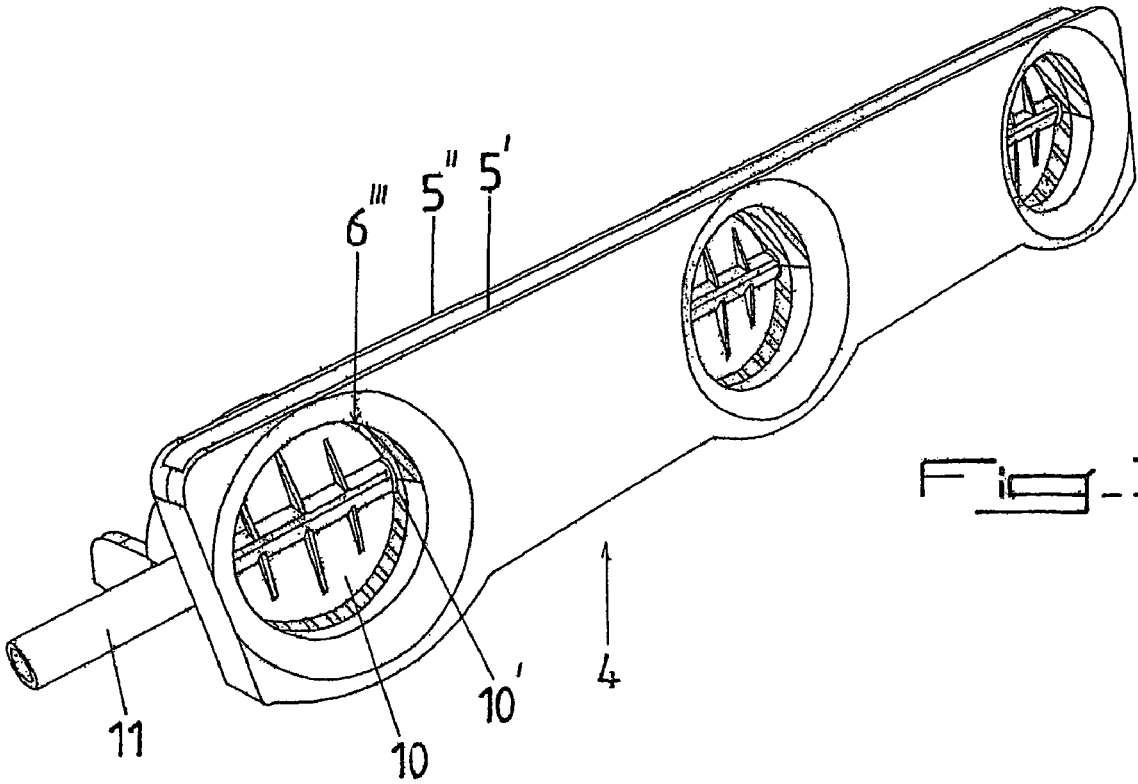
Figure 4:
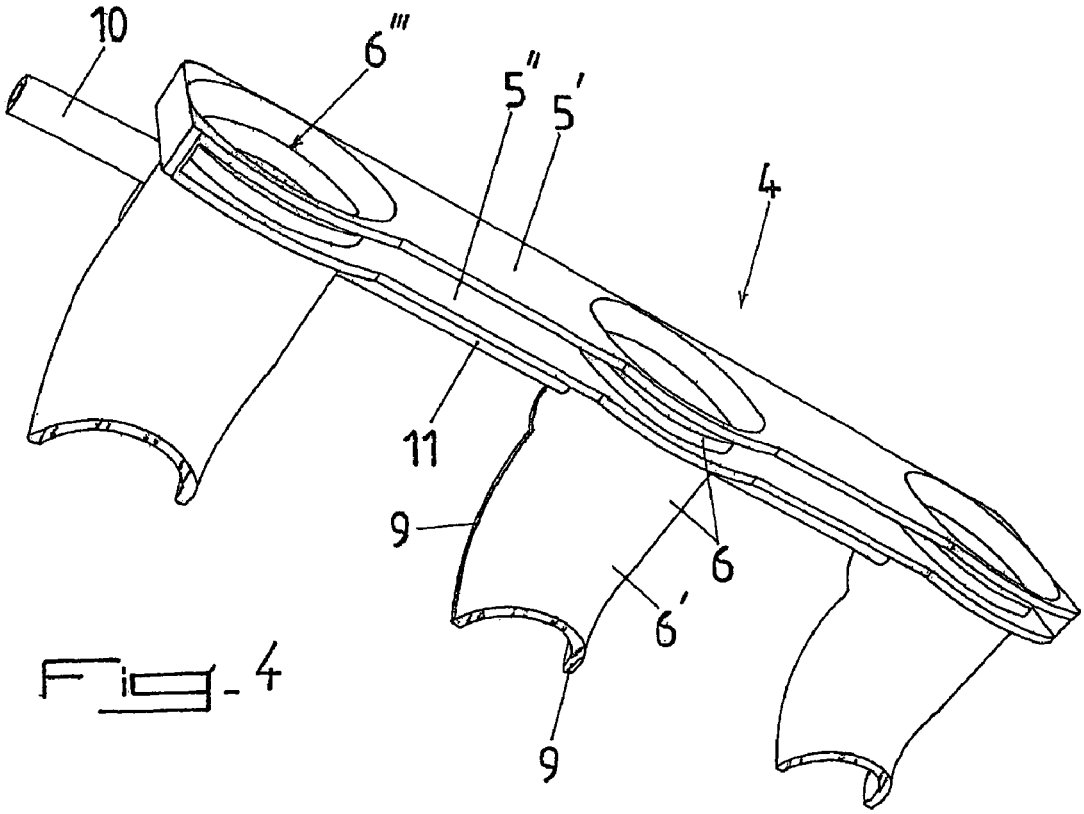

To ensure a good sealing of the pipes 3 in the region of the junction interfaces between the portions 6 and 6' and the portions 6", the pipe portions 6, 6' are provided in the region of their edges intended to come into contact with the mating edges of the complementary portions 6" of said pipes 3 integrated into one 1 of said parts 1, 1' constituting the manifold with a covering 9 which seals by compression, such as an elastomer material attached by duplicate moulding or co-injection on said contact edges of said pipe portions 6, 6' (see FIGS. 2 to 4).

According to an advantageous variation of the invention allowing the flow in the pipes 3 to be regulated, as shown in FIGS. 2 to 6 of the accompanying drawings, the attached piece 4 is provided in the region of each pipe portion 6, 6' with a flap 10 or rotary shutter which can be displaced between a closed position in which it seals the passage in the relevant pipe 3 and an open position in which it frees said passage, said flaps or shutters 10 being mounted on a single control shaft 11 extending through the sleeves 6 forming or extending the inlet apertures of said pipe portions 6, 6' in the region of the adapted fitting orifices 11 on the side of the main body 5 opposed to the apertures 6'" of said inlet orifices.

Preferably, the flaps or shutters 10 are produced by moulding in situ on the control shaft 11, this latter having a non-circular, preferably polygonal, section at least in the region of its segments receiving the flaps 10 by duplicate moulding.

Figure 5:
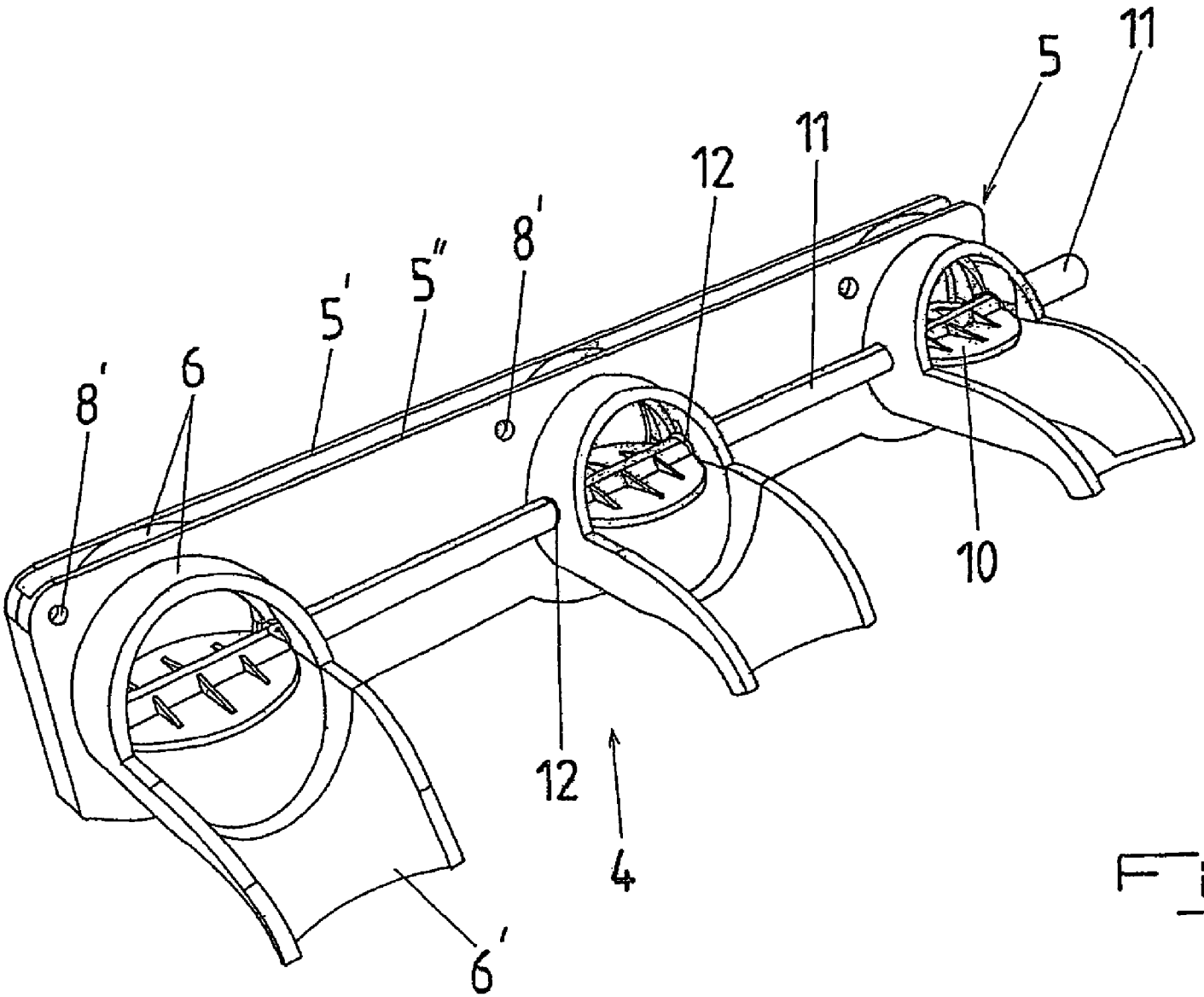
FIG. 5 is a view of the attached piece similar to that in FIG. 2, said piece having the sealing elastomer material artificially removed and the flaps being in the open position.
Figure 7:
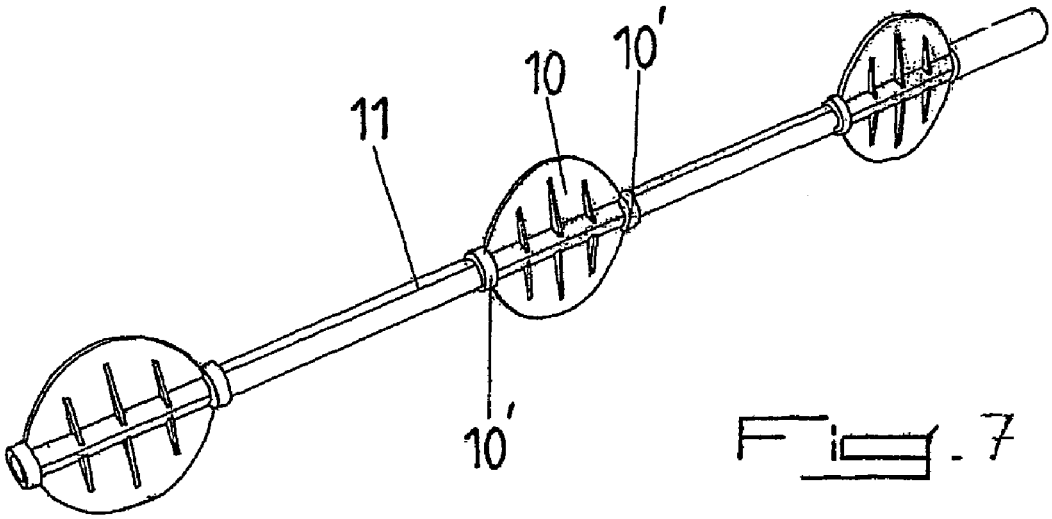
FIG. 7 is a perspective detailed view showing the control shaft and the flaps formed thereon which form part of the manifold according to the invention.
Figure 8:
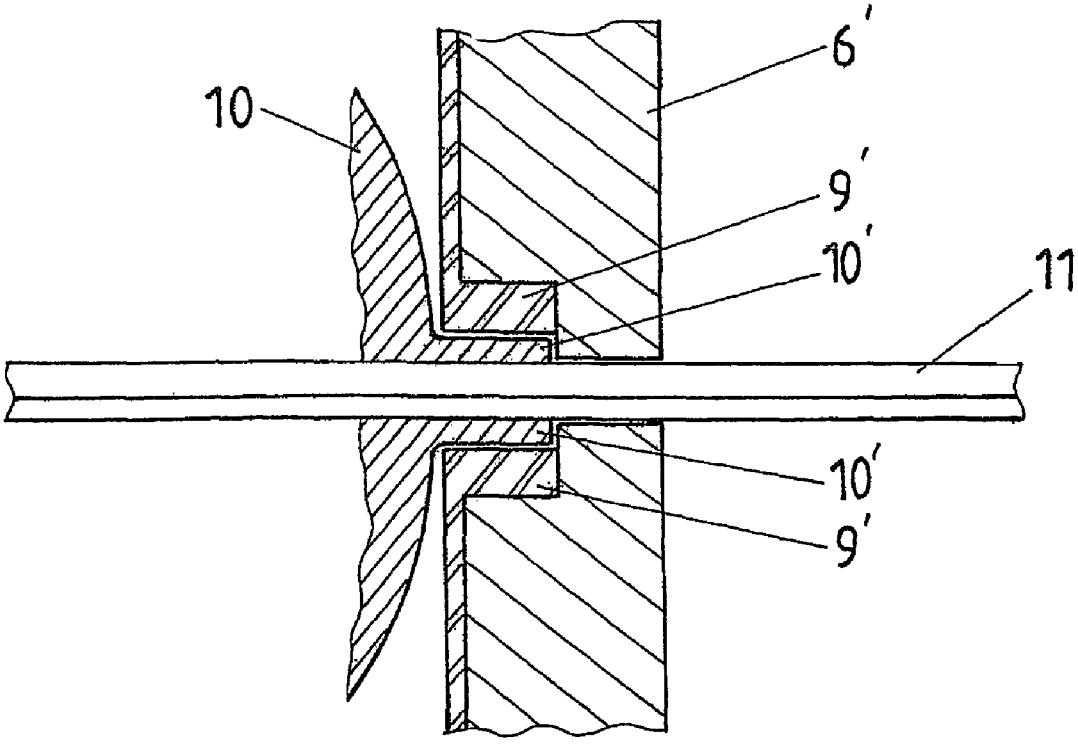
FIG. 8 is a detailed sectional view on a different scale of an assembly and rotatary guide bearing of the unit comprising control shaft/flaps.

To ensure a good seal in the region of the fitting orifices 12 and at the same time simple production of the support bearings of the unit comprising flaps 10/shaft 11, it can be provided that the body of each flap or shutter 10 is extended laterally on the control shaft 11, by sleeves of material 10' which extend at least partially in the two opposed fitting orifices 12 produced in the sleeve 6 of the pipe portion receiving said pivoting flap or shutter 10 and forming rotational guide bearings (see in particular FIGS. 5, 7 and 8).

The shaft 11 is not therefore directly required for the rotational guidance of the abovementioned assembly, but is only used for the positioning and simultaneous rotational displacement of the flaps 10.

Since the axis of rotation and control 11 is placed between the body of flaps and the pipes, when the piece 4 is in place, the shaft 11 is thus invisible for the internal flux and this ensures protection of this shaft with respect to the intake air (mixture of air, oil, REG (recycled exhaust gas) with oxides which may damage a metal shaft).

Moreover, there are no rough areas in the plenum chamber since the shaft, the rotational guides and the stops are masked by the walls of the bodies of the flaps 10. Furthermore, since the bodies of the flaps are produced from plastics materials, it is possible to produce a shape, in the region of the apertures 6'" of the inlet orifices 6 of a trumpet or symmetrical or asymmetrical tulip type allowing the flow of air to be encouraged.

To reduce leaks in the closed position of the flaps 10, each pipe portion 6, 6' can be provided on the internal face of the sleeve wall 6 and in the region of the semi-circular strips facing or in contact with the flap or shutter 10 in a position sealing this latter, with a covering 9' made from a sealing material, in particular an elastomer, attached by duplicate moulding or bi-injection on said wall, said covering 9' also extending at least partially in the fitting orifices 12 of the control shaft 11 and of the flap or shutter 10 produced in the relevant pipe portion 6, 6' (FIGS. 1, 2 and 3).

Thus, the seal between the flaps 10 and the internal wall of the pipes 3 is obtained in the periphery by applying an elastomer covering 9', then in situ injection in the sleeves 6 of the flaps 10 on the elastomer.

In fact, the shape of the flaps 10 intimately matches the internal contour of the pipes 3 defined by the covering 9 in the region of the zone facing the peripheral edge of the flaps 10 when the latter are in the closed position.

The present invention also relates to a process for producing an intake manifold or distributor such as that described above, comprising an intake chamber 2 and a plurality of pipes 3 in fluidic communication with said chamber, characterised in that it consists in providing the different parts 1, 1' constituting the body of the manifold, and an additional piece 4 comprised at least of a main body 5 forming a support and fitting plate and a plurality of pipe portions 6, 6', then attaching, by partial interlocking, said additional piece 4 onto the part constituting the manifold 1 incorporating the complementary pipe portions 6', if applicable fixing it or locking it in position, then assembling the various constituent parts 1, 1' of said manifold.

As shown in FIG. 1 of the accompanying drawings the constituent parts of the manifold 1, 1' are preferably two in number, produced in thermoplastic material and assembled by vibration welding in the region of the cooperating adapted assembly zones 1".

According to an advantageous variation of the invention, the attached piece 4 is obtained by injection moulding of thermoplastic material and duplicate injection moulding of elastomer material 9, 9' at given locations of pipe portions 6, 6' then if necessary, positioning a control shaft 11 and injecting sealing flaps 10 in closed position on this shaft 11 and on said elastomer material 9, 9', in the various pipe portions 6, 6', followed by differential contraction of the material constituting the bodies of said flaps 10.

The piece 4 is therefore obtained by successive multi-injections of the thermoplastic material forming, in a single piece, the body 4 and the pipe portions 6 and 6' then of the coverings 9 and 9' made from elastomer material, and finally of the thermoplastic material constituting the flaps 10, after positioning of the shaft 11, the flaps 10 being injection-moulded in the closed position to obtain a good peripheral seal.

Rotation of the flaps 10 in the sleeves 6 which form the support and guide body thereof is made possible by the controlled differential contraction of the two thermoplastic materials which form the flaps 10 and the attached piece 4 (body 5+portions 6, 6').

It should be noted that the invention allows, with two identical parts 1 and 1', the production of a whole range of different distributors, each of the latter comprising attached pieces or inserts 4 with different shapes, structures and dimensions which can be fitted in an adjusted manner in adapted sites of one of the two parts and constituting with this latter, by complementarity of shape, intake pipes.

These various attached pieces 4 may comprise pipe portions 6, 6' with or without flaps 10, with different lengths and/or diameters and different or similar aperture configurations.

Obviously, the invention is not limited to the embodiment described and shown in the accompanying drawings, in particular as regards the shape or the manifold and pipes. Modifications remain possible, in particular from the viewpoint of the constitution of the various elements of by substitution of technical equivalents, without departing from the scope of protection of the invention.

The invention claim is:

1. Intake manifold for thermal engine comprising a first part (1) and a second part (1'), said first and second parts (1, 1') being made from thermoplastic material and assembled directly together, and an additional attached piece (4) positioned on said first part (1) and housed within at least one of said first part (1) and second part (1'), said manifold comprising plenum chamber (2) connected, for fluidic communication, to intake pipes (3) opening into said plenum chamber (2), wherein the additional attached piece (4) is composed of a main body (5) forming a support and fitting plate and of intake pipe portions (6, 6') produced in one piece with said main body (5) and comprising sleeves (6) defining at least inlet orifices of said intake pipes (3) opening onto said plenum chamber (2).

2. Intake manifold for thermal engine comprising a first part (1) and a second part (1'), said first and second parts (1, 1') being made from thermoplastic material and assembled together, and an additional attached piece (4) positioned on or in one of these said parts (1, 1'), said manifold comprising a plenum chamber (2) connected, for fluidic communication, to intake pipes (3) opening into said plenum chamber (2), wherein the additional attached piece (4) is composed of a main body (5) forming a support and fitting plate and of pipe portions (6, 6') produced in one piece with said main body (5) and comprising sleeves (6) defining at least inlet orifices of said intake pipes (3) opening onto said plenum chamber (2), and wherein the intake pipe portions (6, 6') comprise conduit parts (6') extending said sleeves (6) and forming portions with a substantially semi-circular section, at least partially constituting said pipes (3) together with complementary portions (6") formed in one of said parts (1), said complementary portions (6") being complementary in shape to conduit parts (6').

3. Manifold according to claim 2, wherein said first part (1) comprising said complementary portions (6") of the intake pipes (3) is provided with a wall portion (7) for fitting to the main body (5) of the attached piece (4), said wall portion (7) being provided with apertures (7') for the passage of said pipe portions (6, 6') of said attached piece (4) and for the adjusted interlocking of at least some of said sleeves (6) of said attached piece (4).

4. Manifold according to claim 3, wherein the wall portion (7) is provided with a plurality of projections (8) which cooperate with complementary apertures (8') on the main body (5) of the attached piece (4) upon fitting the latter on said wall portion (7).

5. Manifold according to claim 1, wherein the main body (5) of the attached piece (4) has a plane structure and is comprised of two parallel plates (5', 5") connected to one another by cross-members composed of said sleeves (6), the intake pipes (3) being aligned with one another in a parallel arrangement.

6. Manifold according to claim 2, wherein the pipe portions (6, 6') comprise a covering (9) provided in the region of edges of the pipe portions (6, 6') that come into contact with mating edges of the complementary portions (6") of said pipes (3) formed in said first part (1) of the manifolds, wherein said covering (9) seals by compression the edges of the pipe portions that come into contact with mating edges of the complementary portions (6").

7. Manifold according to claim 1, wherein the attached piece (4) is provided, with a rotary shutter (10) which can be displaced between a closed position in which it seals the passage in the relevant pipe (3) and an open position in which it frees said passage, said shutters (10) being mounted on a single control shaft (11) extending through said sleeves (6).

8. Manifold according to claim 7, wherein the shutters (10) are produced by molding in situ on the control shaft (11), said control shaft (11) having a non-circular section at least in the region of its segments receiving the shutters (10) by duplicate molding.

9. Manifold according to claim 7, wherein a body of each shutter (10) comprises a sleeve of material (10') extending laterally on the control shaft (11), said sleeves of material (10') extending at least partially into two opposed fitting orifices (12) which are formed in said sleeve (6) of the pipe portion receiving said shutter (10), and which form rotary guide bearings.

10. Manifold according to claim 9, wherein each pipe portion (6, 6') is provided, on an internal face of the sleeve (6) and in the region of semi-circular strips facing the shutter (10) in a position sealing this latter, with a covering (9') made from a sealing material attached on said wall, said covering (9') also extending at least partially in said fitting orifices (12).

11. Process for producing an intake manifold according to claim 2, comprising the steps of attaching, by partial interlocking, said additional piece (4) onto said first part (1) of the manifold having the complementary portions (6"), and then assembling said first and second parts (1, 1') of said manifold.

12. Process according to claim 11, wherein said first and second parts (1, 1') of the manifold are assembled by vibration welding.

13. Process according to claim 11, wherein the additional piece (4) is produced by injection molding of thermoplastic material and bi-injection molding of elastomer material (9, 9') at given locations of the pipe portions (6, 6').

14. Process according to claim 12, wherein the additional piece (4) is produced by injection molding of thermoplastic material and bi-injection molding of elastomer material (9, 9') at given locations of the pipe portions (6, 6').

15. Process according to claim 13, further comprising the steps of positioning a control shaft (11) through said sleeves (6), and injecting sealing shutters (10) in closed position on the control shaft (11) and on said elastomer material (9, 9'), in the pipe portions (6, 6').

16. Manifold according to claim 2, wherein the main body (5) of the attached piece (4) has a plane structure and is comprised of two parallel plates (5', 5") connected to one another by cross-members composed of said sleeves (6), the intake pipes (3) being aligned with one another in a parallel arrangement.

17. Manifold according to claim 3, wherein the main body (5) of the attached piece (4) has a plane structure and is comprised of two parallel plates (5', 5") connected to one another by cross-members composed of said sleeves (6), the intake pipes (3) being aligned with one another in a parallel arrangement.

18. Manifold according to claim 3, wherein the pipe portions (6, 6') comprise a covering (9) provided in the region of edges of the pipe portions (6, 6') that come into contact with mating edges of the complementary portions (6") of said pipes (3) formed in said first part (1) of the manifolds, wherein said covering (9) seals by compression the edges of the pipe portions that come into contact with mating edges of the complementary portions (6").

19. Manifold according to claim 2, wherein the attached piece (4) is provided with a rotary shutter (10) which can be displaced between a closed position in which it seals the passage in the relevant pipe (3) and an open position in which it frees said passage, said shutters (10) being mounted on a single control shaft (11) extending through said sleeves (6).

20. Manifold according to claim 8, wherein a body of each shutter (10) comprises a sleeve of material (10') extending laterally on the control shaft (11), said sleeves of material (10') extending at least partially into two opposed fitting orifices (12) which are formed in said sleeve (6) of the pipe portion receiving said shutter (10), and which form rotary guide bearings.

* * * * *

UNITED STATES PATENT AND TRADEMARK OFFICE

CERTIFICATE OF CORRECTION

PATENT NO. : 7,047,926 B2
APPLICATION NO. : 10/250600
DATED : May 23, 2006
INVENTOR(S) : Corduan et al.

It is certified that error appears in the above-identified patent and that said Letters Patent is hereby corrected as shown below:

Title Page,

In Item [73], Assignee, after "Mark IV Systemes Moteurs", insert the following:

--(Societe Anonyme)--

Signed and Sealed this

Fourteenth Day of November, 2006

JON W. DUDAS
*Director of the United States Patent and Trademark Office*